US011414848B2

(12) United States Patent
Park et al.

(10) Patent No.: US 11,414,848 B2
(45) Date of Patent: Aug. 16, 2022

(54) WATER PURIFIER

(71) Applicant: LG ELECTRONICS INC., Seoul (KR)

(72) Inventors: Jongwoo Park, Seoul (KR); Kwangyong An, Seoul (KR); Seonwoong Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 50 days.

(21) Appl. No.: 16/975,342

(22) PCT Filed: Oct. 25, 2018

(86) PCT No.: PCT/KR2018/012718
§ 371 (c)(1),
(2) Date: Aug. 24, 2020

(87) PCT Pub. No.: WO2019/164086
PCT Pub. Date: Aug. 29, 2019

(65) Prior Publication Data

US 2020/0399872 A1 Dec. 24, 2020

(30) Foreign Application Priority Data

Feb. 23, 2018 (KR) ..... 10-2018-0021932

(51) Int. Cl.
*F16K 49/00* (2006.01)
*E03C 1/044* (2006.01)
(Continued)

(52) U.S. Cl.
CPC ..... *E03C 1/044* (2013.01); *B67D 1/0801* (2013.01); *B67D 1/0859* (2013.01); *F25D 31/003* (2013.01); *B67D 2210/0001* (2013.01)

(58) Field of Classification Search
CPC ... E03C 1/044; C02F 2307/10; B67D 1/0859; B67D 2210/0001; F25D 31/003
See application file for complete search history.

(56) References Cited

U.S. PATENT DOCUMENTS 4,124,994 A * 11/1978 Cornelius ..... F25C 1/08 62/138
2011/0186283 A1* 8/2011 Preston ..... F25D 31/003 165/287

(Continued)

FOREIGN PATENT DOCUMENTS

KR 10-2011-0065979 A 6/2011
KR 10-2017-0024969 A 3/2017

(Continued)

OTHER PUBLICATIONS

International Search Report (PCT/ISA/210) issued in PCT/KR2018/012718 dated Jan. 31, 2019.

*Primary Examiner* — Reinaldo Sanchez-Medina
(74) *Attorney, Agent, or Firm* — Birch, Stewart, Kolasch & Birch, LLP

(57) ABSTRACT

Disclosed herein is a water purifier, in which a partitioning container is detachably mounted on the bottom surface of a tank cover, and an agitator is inserted into the partitioning container to be connected to an agitating motor mounted in the tank cover in a state where the partitioning container is mounted on the bottom surface of the tank cover. By this structure, the inner diameter of the partitioning container may be less than the outer diameter of the blade of the agitator.

16 Claims, 10 Drawing Sheets

(51) Int. Cl.
*B67D 1/08* (2006.01)
*F25D 31/00* (2006.01)

(56) References Cited

U.S. PATENT DOCUMENTS

| | | | | |
|---|---|---|---|---|
| 2014/0088550 | A1 | 3/2014 | Bené et al. | |
| 2017/0153056 | A1* | 6/2017 | Kim | B01D 35/30 |
| 2018/0016128 | A1 | 1/2018 | Park et al. | |
| 2018/0016129 | A1* | 1/2018 | Park | B67D 1/0864 |
| 2018/0056217 | A1* | 3/2018 | Park | B01D 35/306 |
| 2018/0216868 | A1 | 8/2018 | Park et al. | |

FOREIGN PATENT DOCUMENTS

| | | | |
|---|---|---|---|
| KR | 10-2018-0013020 | A | 2/2018 |
| WO | WO 2017/034209 | A1 | 3/2017 |

* cited by examiner

【Figure 1】
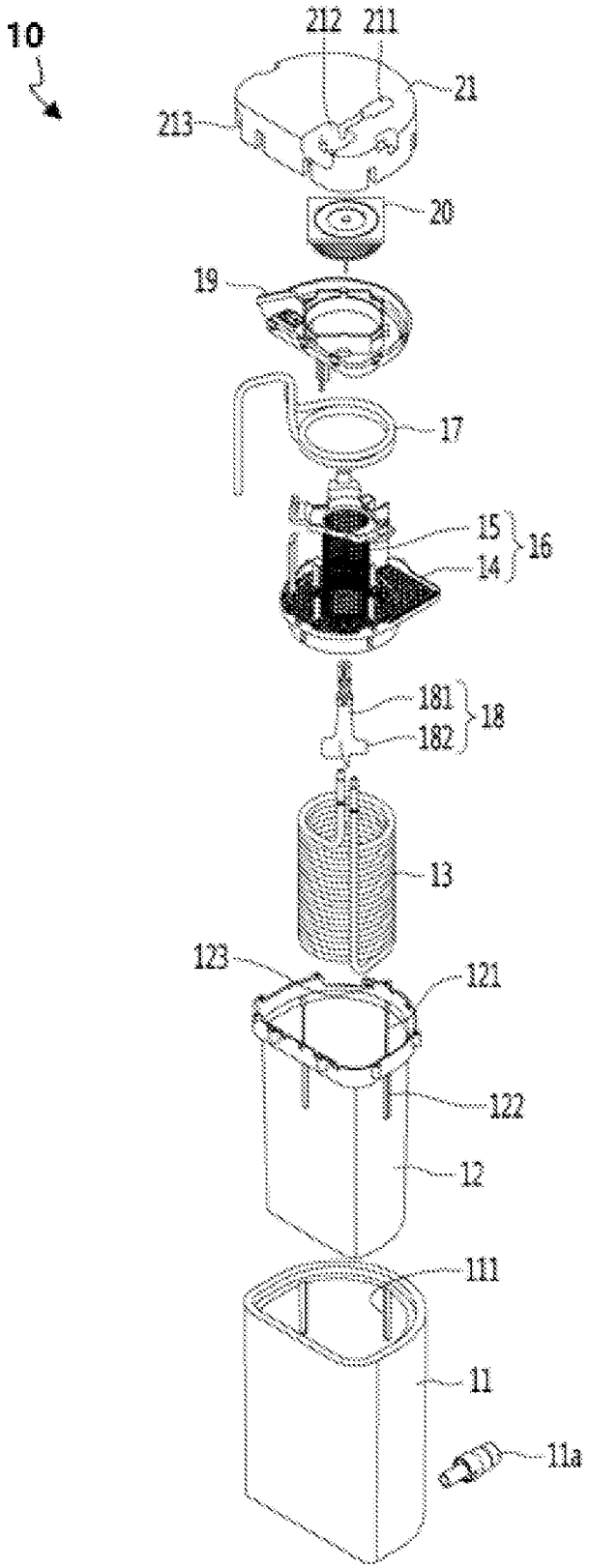

[Fig. 2]
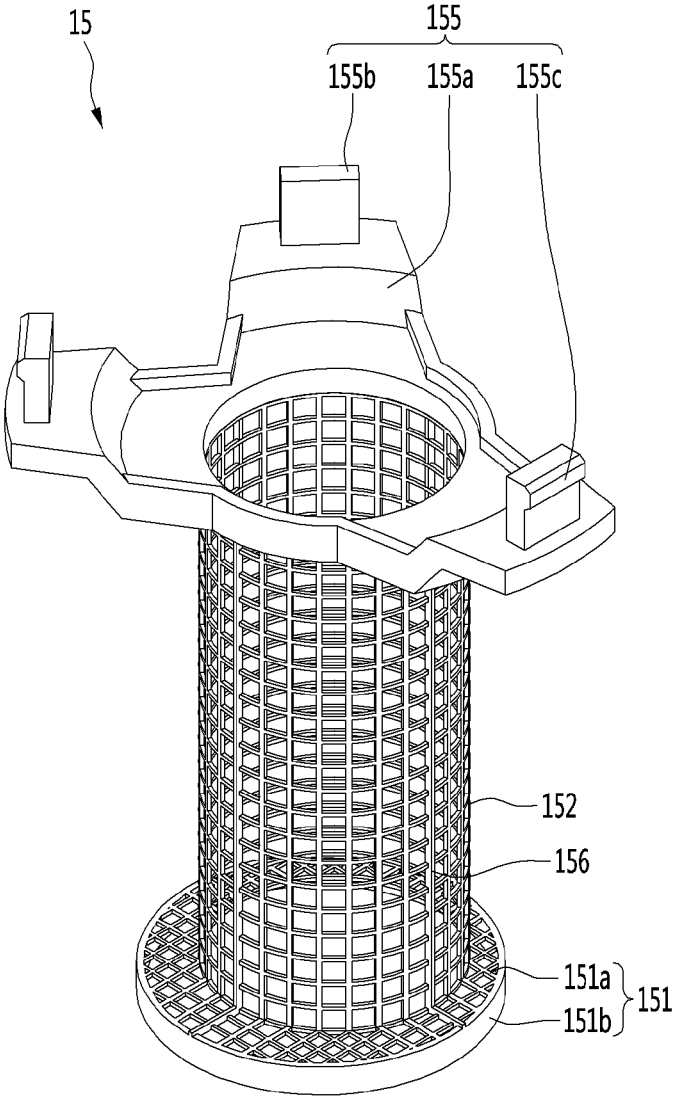

[Fig. 3]
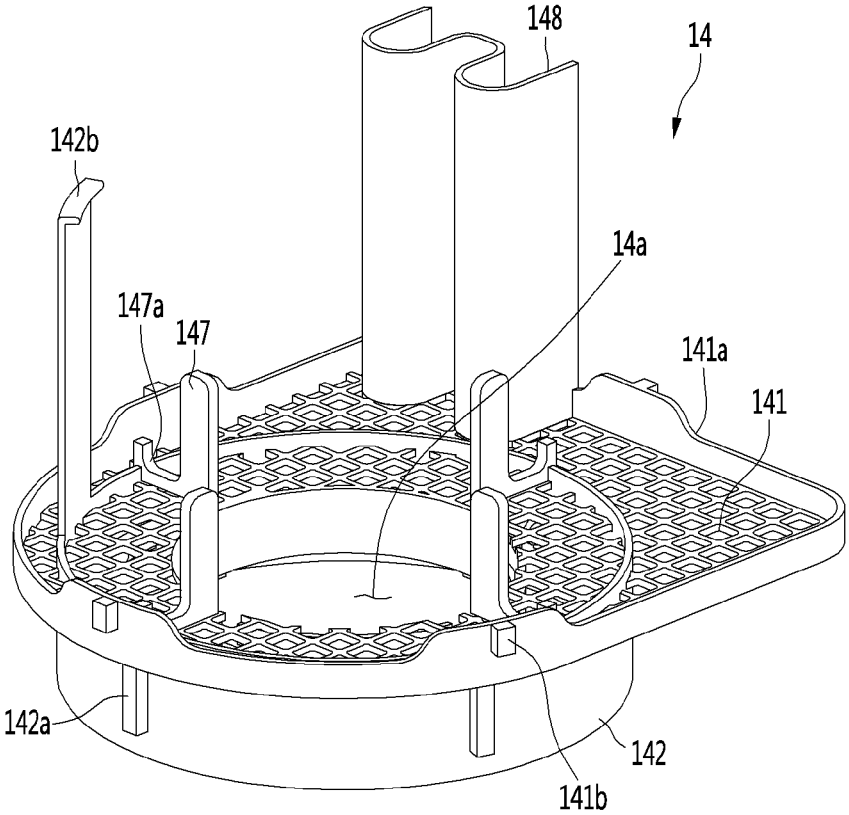
[Fig. 4]
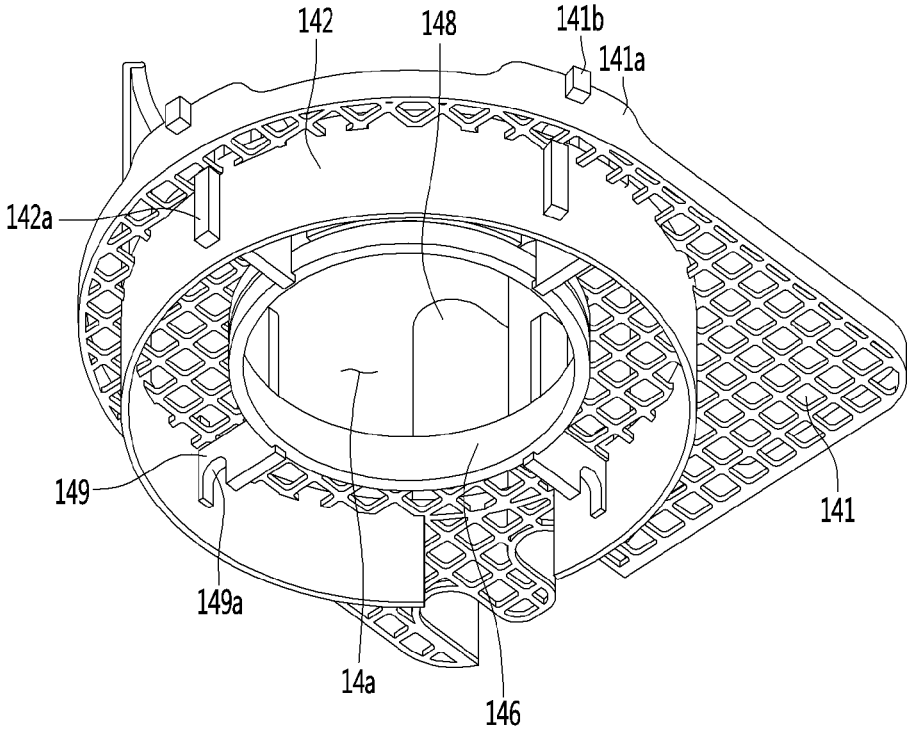

[Fig. 5]
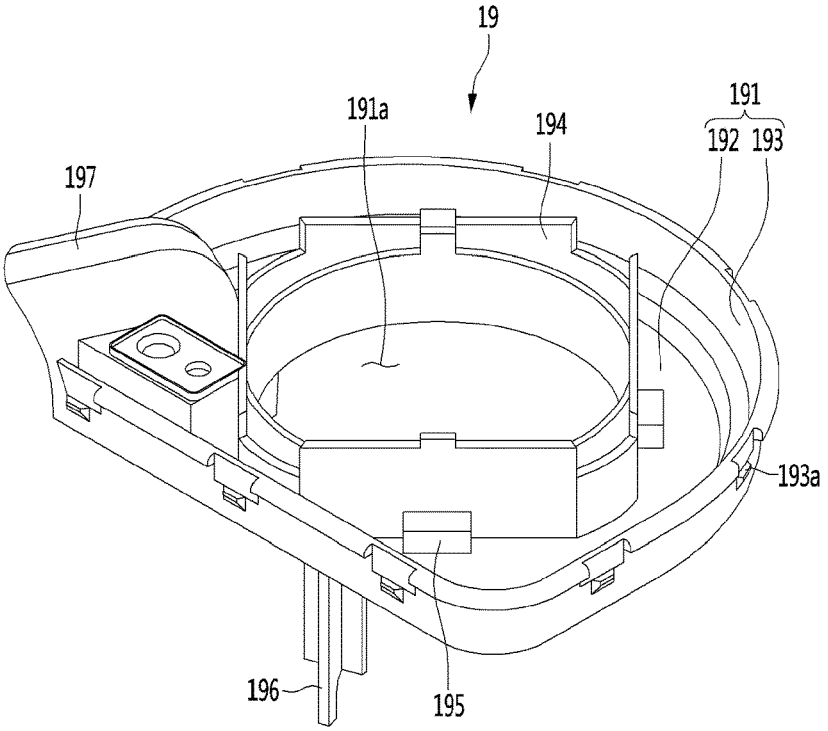
[Fig. 6]
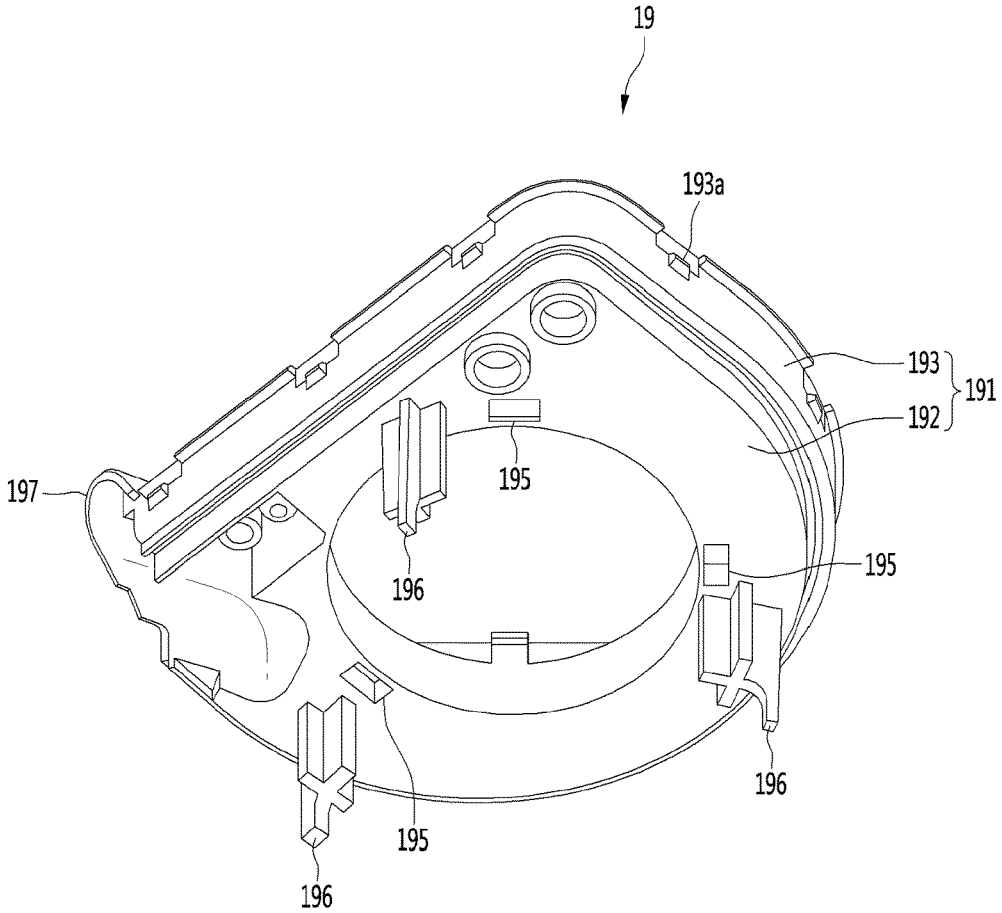

[Fig. 7]
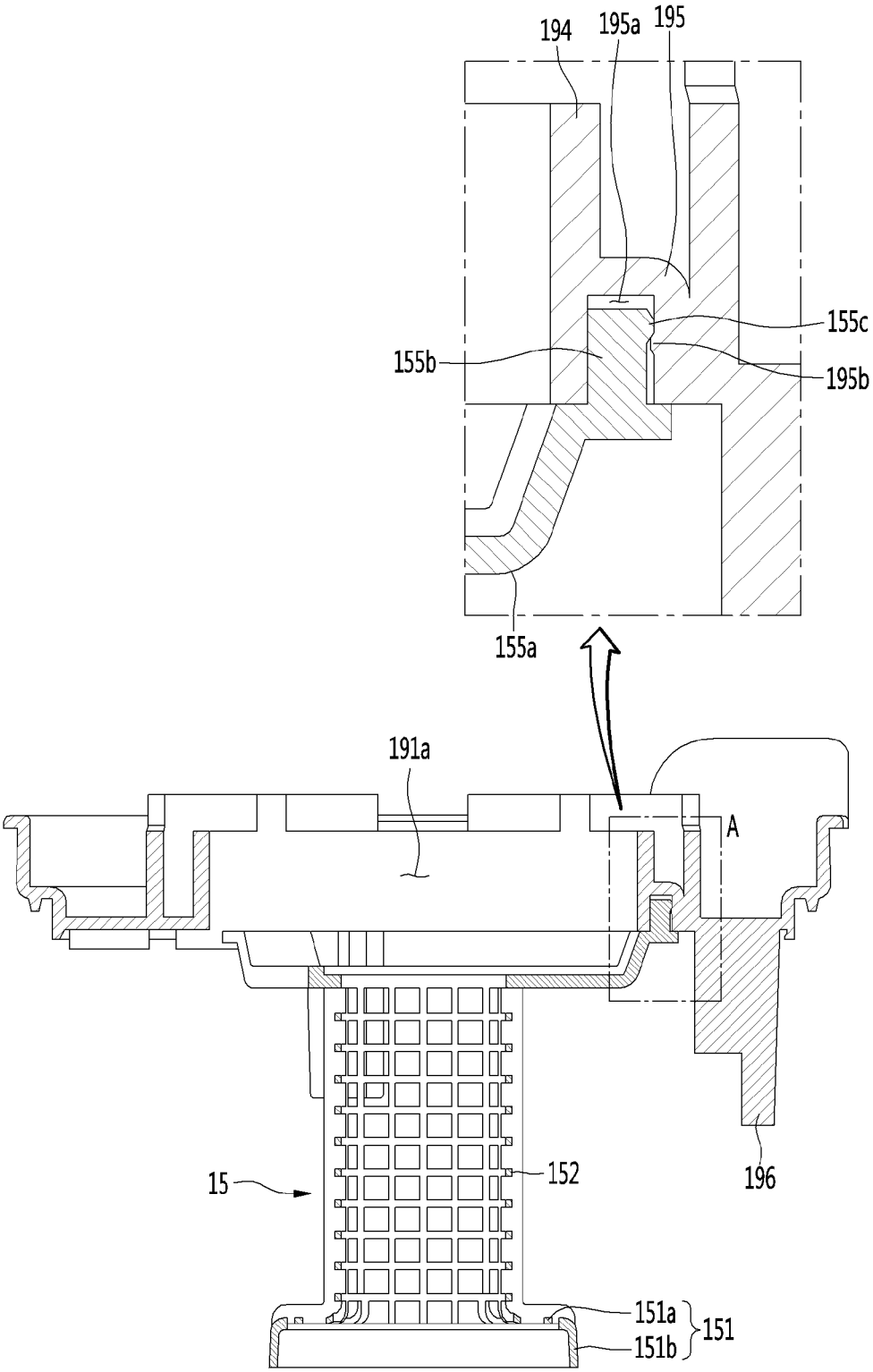

[Fig. 8]
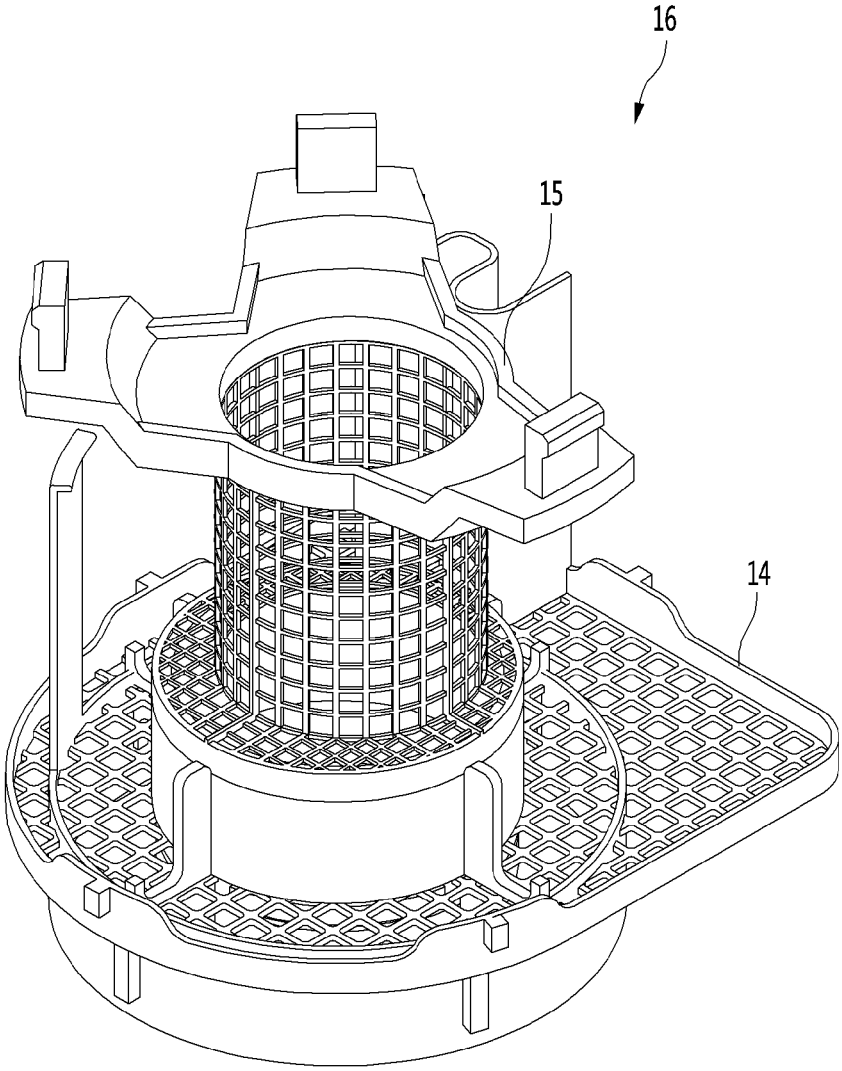

[Fig. 9]
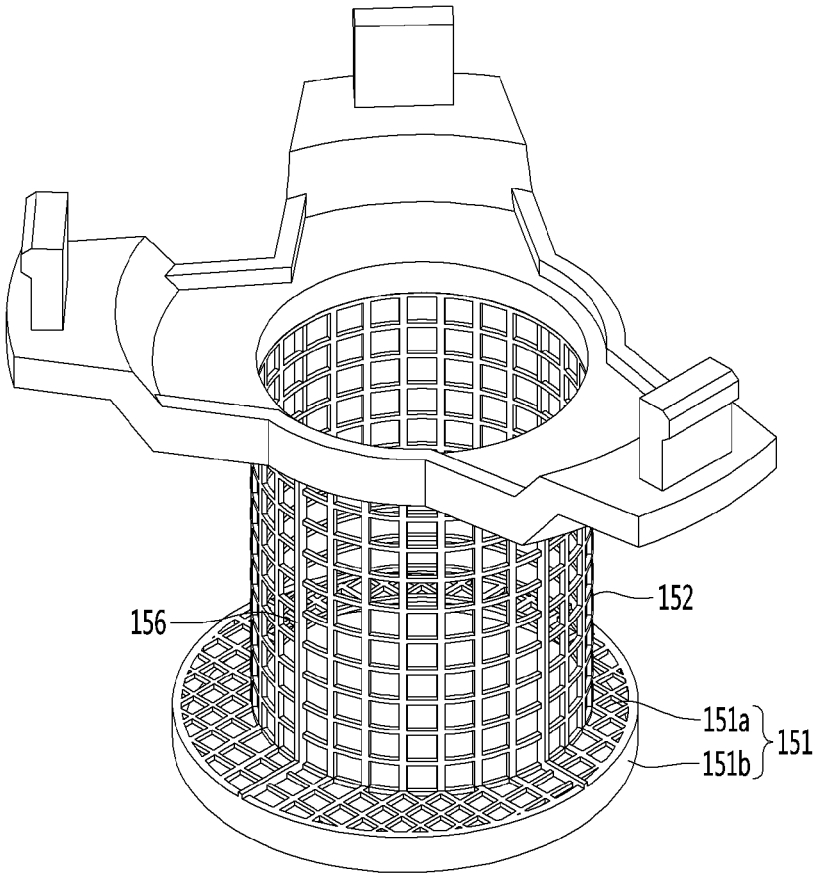

[Fig. 10]
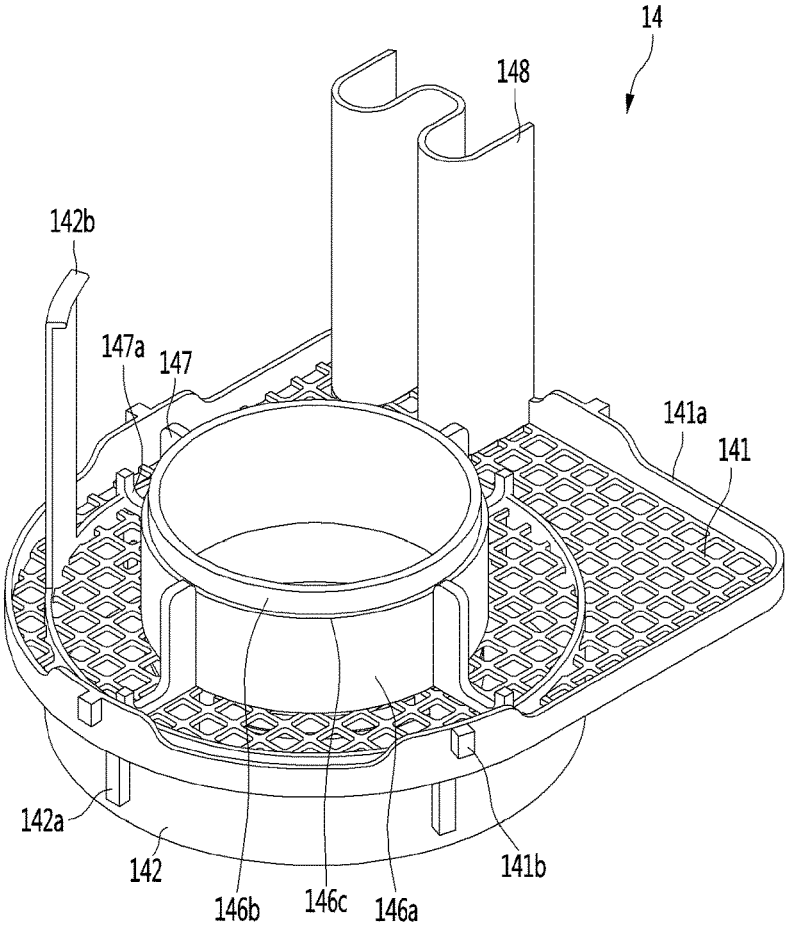
[Fig. 11]
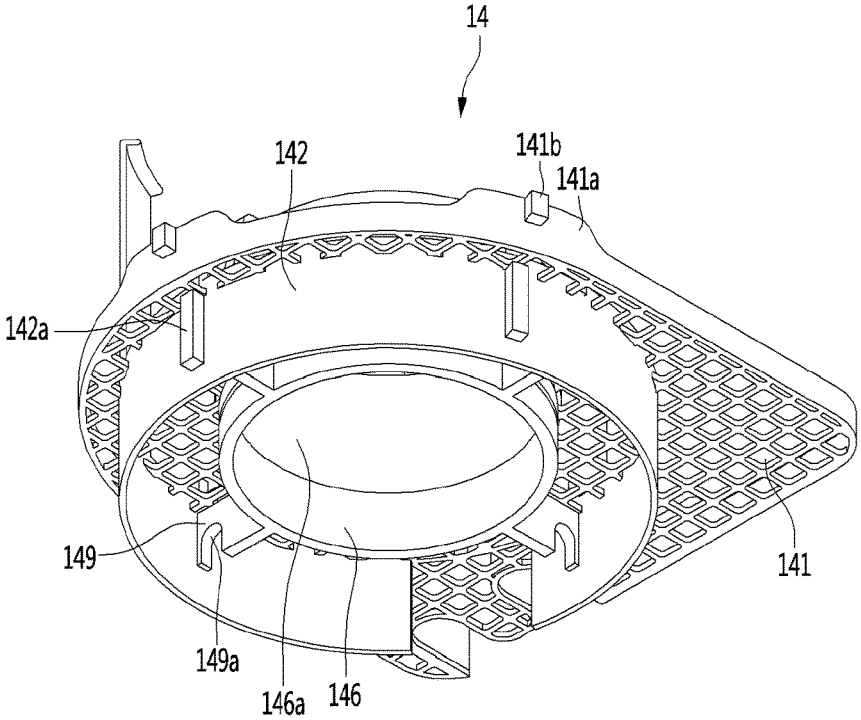

[Fig. 12]
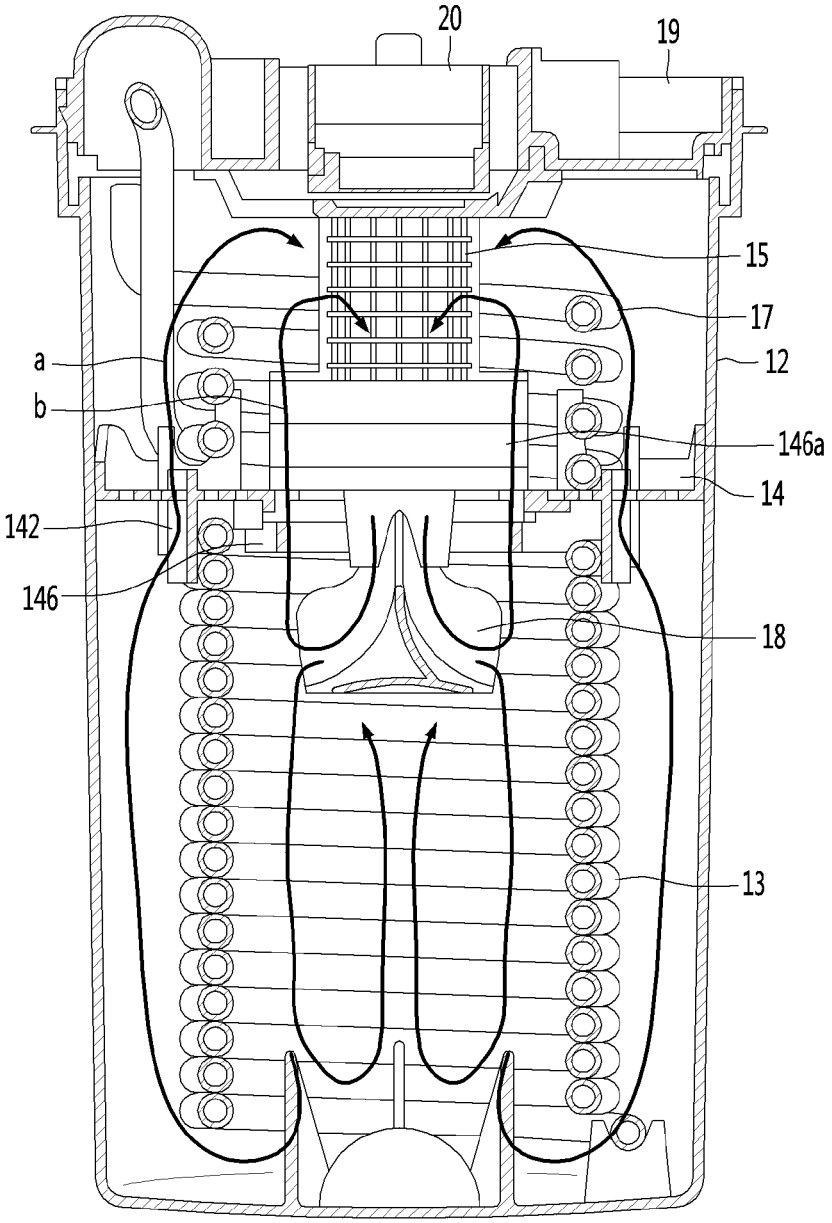

[Fig. 13]
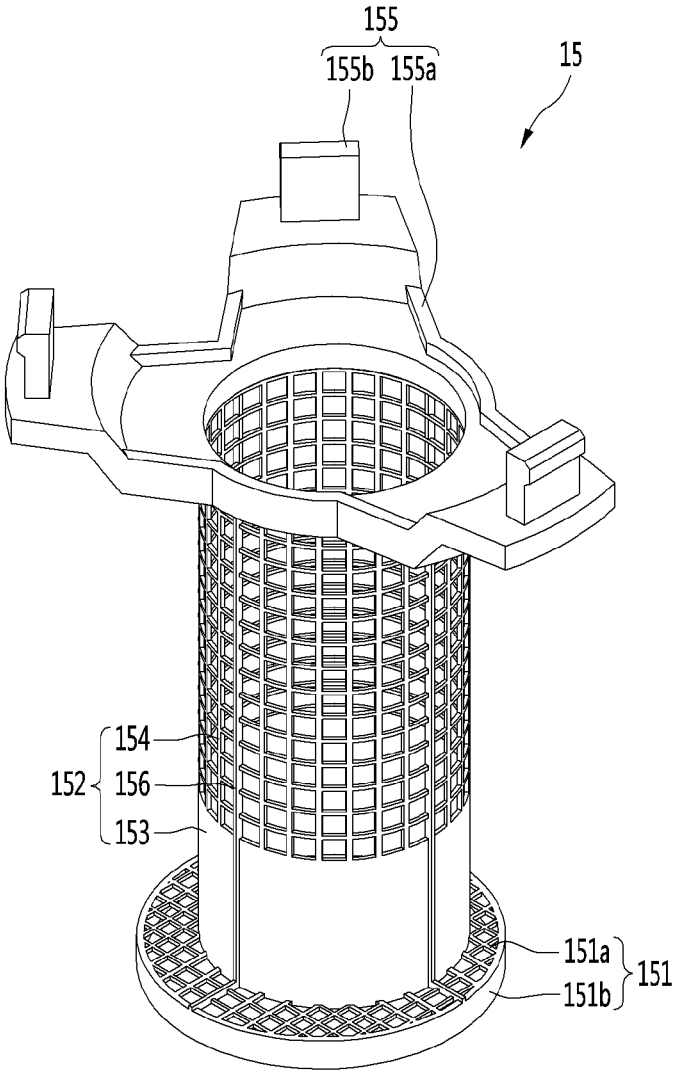

WATER PURIFIER

CROSS REFERENCE TO RELATED APPLICATIONS

This application is the National Phase of PCT International Application No. PCT/KR20187012718, filed on Oct. 25, 2018, which claims priority under U.S.C, 119(*a*) to Patent Application No. 10-2018-0021932, filed in the Republic of Korea on Feb. 23, 2018, all of which are hereby expressly incorporated by reference into the present application.

TECHNICAL FIELD

The present invention relates to a water purifier.

BACKGROUND ART

A water purifier is a device for filtering out harmful elements such as foreign materials or heavy metals contained in water using physical and/or chemical methods.

The prior art described below discloses a direct type water purifier.

The direct type water purifier means a water purifier for coolant supplied through a water tap to a set temperature through a cooling unit and directly supplying water to a consumer without using a water tank, when the consumer pressing a water supply button.

Since the direct type water purifier does not require the water tank, there is no problem that foreign materials are accumulated on the bottom of the water tank and that bacteria propagate in the water tank.

The direct type water purifier includes a coolant tank in which coolant is stored, a cold water pipe and an evaporator disposed in the coolant tank, and a partitioning plate disposed in the coolant tank to partition the internal space of the coolant tank into a space, in which the cold water pipe is received, and a space, in which the evaporator is received, as disclosed in the prior art.

In addition, coolant at an upper side and cooled by the evaporator flows downwardly toward the cold water pipe by rotation of an agitator and cold water in the space, in which the cold water pipe is received, flows upwardly toward the evaporator.

In addition, when a lump of ice is generated on the surface of the evaporator to ac-cumulate cold air, since heat exchange is performed by latent heat as well as sensible heat, it is possible to cool drinking water passing through the cold water pipe in a short time, which is advantageous for the direct type water purifier.

A passing hole, through which the agitator passes, is formed in the center of the partitioning plate. The blade of the agitator is placed below the partitioning plate such that coolant circulates in the upward and downward direction of the partitioning plate.

At this time, ice may be generated around the evaporator placed above the partitioning plate. Pieces of ice separated from the generated ice may flow toward the agitator through the passing hole of the partitioning plate. Then, when the agitator rotates, the pieces of ice collide with the blade of the agitator, thereby causing noise.

In order to solve such a problem, a cylindrical partitioning container is formed on the central portion of the partitioning plate to extend upwardly. The partitioning container may be injection-molded integrally with the partitioning plate and may be formed as a separate part to be detachably coupled to the partitioning plate.

The inner diameter of the partitioning container should be greater than the outer diameter of the blade of the agitator, in order to place the agitator below the partitioning plate through the passing hole of the partitioning plate.

The direct type water purifier having such a structure has the following disad-vantages.

First, the evaporator is disposed outside the partitioning container and is wound in a spiral shape, and a lump of ice having a tube shape is generated on the surface of the evaporator. However, since the partitioning container acts as an obstacle, there is a limitation on growth of the ice.

As the size of ice increases, since the amount of latent heat for heat exchange with coolant is large, the amount of discharged cold water increases. However, the inner diameter of the partitioning container cannot be less than the outer diameter of the blade of the agitator. This is because a combination of the agitator and the agitating motor is assembled in the coolant tank after the partitioning plate and the partitioning container are installed in the coolant tank.

In the conventional structure, if ice is excessively grown, the ice may move into the partitioning container to collide with the agitator, thereby causing noise.

Second, as the size of ice generated around the evaporator increases, the coolant below the partitioning plate does not move to the upper side of the partitioning plate, such that heat exchange between the ice and the coolant is not rapidly performed.

PRIOR ART DOCUMENT

Patent Document

Korean Unexamined Patent Publication No. 2017-0024969 (Mar. 8, 2017)

DISCLOSURE OF INVENTION

Technical Problem

An object of the present invention is to solve the above-described problems.

Solution to Problem

To achieve the above objects, there is provided a water purifier, in which a partitioning container is detachably mounted on the bottom surface of a tank cover, and an agitator is inserted into the partitioning container to be connected to an agitating motor mounted in the tank cover, in a state where the partitioning container is mounted on the bottom surface of the tank cover. By this structure, the inner diameter of the partitioning container may be less than the outer diameter of the blade of the agitator.

In addition, by forming water flow guide sleeves on the bottom and upper surfaces of the partitioning plate, coolant flowing by the agitator can smoothly rise to the upper region of the evaporator.

Advantageous Effects of Invention

The water purifier according to the embodiment of the present invention including the above configuration has the following effects.

First, since the shaft of the agitator is inserted from the lower side of the partitioning container in a state where the partitioning container is installed on the bottom surface of the tank cover and then is connected to the shaft of the agitating motor, the inner diameter of the partitioning container may be less than the outer diameter of the blade of the agitator. As a result, even if the size of the size of the ice generated around the evaporator is excessively grown, it is possible to prevent ice pieces from moving into the partitioning container. Therefore, it is possible to reduce a possibility that the ice moving into the partitioning container collides with the agitator to cause noise.

Second, since the water flow guide rib for guiding coolant flow upwardly and/or the blocking portion are formed in the partitioning plate and/or the partitioning container, coolant at the lower side of the partitioning plate can smoothly rise, thereby sufficiently performing heat exchange with the ice located at the upper side of the partitioning plate. As a result, the latent heat of the ice and the sensible heat of the coolant exchange heat with drinking water passing through the cold water pipe, thereby dis-charging a larger amount of cold water.

BRIEF DESCRIPTION OF DRAWINGS

FIG. 1 is an exploded perspective view of a cooling unit provided in a water purifier according to an embodiment of the present invention.

FIG. 2 is a perspective view of a partitioning container configuring a partitioner according to a first embodiment of the present invention.

FIG. 3 is a planar perspective view of a partitioning plate configuring the partitioner according to the first embodiment of the present invention.

FIG. 4 is a bottom perspective view of the partitioning plate.

FIG. 5 is a planar perspective view of a tank cover according to an embodiment of the present invention.

FIG. 6 is a bottom perspective view of the tank cover.

FIG. 7 is a vertical cross-sectional view showing a coupling relationship between the tank cover and the partitioning container.

FIG. 8 is a perspective view of a partitioner according to a second embodiment of the present invention.

FIG. 9 is a perspective view of a partitioning container configuring the partitioner according to the second embodiment of the present invention.

FIG. 10 is a planar perspective view of a partitioning plate according to the second embodiment of the present invention.

FIG. 11 is a bottom perspective view of the partitioning plate according to the second embodiment of the present invention.

FIG. 12 is a cross-sectional view showing flow of coolant in a cooling unit according to the second embodiment of the present invention.

FIG. 13 is a perspective view of a partitioning container configuring a cooling unit according to a third embodiment of the present invention.

BEST MODE FOR CARRYING OUT THE INVENTION

Hereinafter, the structure of a cooling unit of a water purifier according to an embodiment of the present invention will be described in detail with reference to the drawings.

FIG. 1 is an exploded perspective view of a cooling unit provided in a water purifier according to an embodiment of the present invention.

Since the cooling unit 10 according to the embodiment of the present invention is ap-plicable to the water purifier disclosed in the above-described prior art, the structures and functions of the components excluding the cooling unit 10, and the water supply flow channels of cold water, hot water and purified water in the water purifier will be omitted.

Referring to FIG. 1, the cooling unit 10 according to the embodiment of the present invention includes a coolant tank 12 in which coolant is stored, an insulation case 11 surrounding the outer surface of the coolant tank 12 to insulate the coolant from outside air, and a drain valve 11*a* mounted on a lower end of the insulation case 11 to discharge coolant.

In addition, the cooling unit 10 further includes a cold water pipe 13 accommodated in the coolant tank 12 and having drinking water flowing therein, a partitioner 16 accommodated in the coolant tank 12 in a state of being placed on the cold water pipe 13, an evaporator 17 placed on the partitioner 16, and an agitator 18 is placed in an inner space defined by the cold water pipe 13 after passing through the partitioner 16.

The partitioner 16 includes a partitioning plate 14 and a cylindrical partitioning container 15 detachably coupled to the partitioning plate 14.

Specifically, the partitioning plate 14 is horizontally placed in the coolant tank 12 to partition the internal space of the coolant tank 12 into an upper space, in which the evaporator 17 is placed, and a lower space, in which the cold water pipe 13 is placed.

In addition, a plurality of grid ribs are formed in the partitioning plate 14 to enable coolant above the partitioning plate 14 and coolant below the partitioning plate 14 to circulate by operation of the agitator 18.

In addition, the evaporator 17 is provided outside the partitioning container 15 to be wound in a plurality of turns in the circumferential direction of the partitioning container 15. The plurality of grid ribs is formed in the partitioning container 15 to prevent ice generated around the evaporator 17 from flowing into the lower space in which the cold water pipe 13 is accommodated.

In addition, the agitator 18 is placed in the space defined inside the cold water pipe 13 through an opening formed in the partitioning container 15. The cold water pipe 13 may be wound in a spiral shape to have a cylindrical shape having a predetermined length and diameter as shown in the figure.

In addition, the cooling unit 10 further includes a tank cover 19 covering the opened upper end of the coolant tank 12, an agitating motor 20 seated on the upper surface of the tank cover 19, and a case cover 21 covering the upper end of the insulation case 11 at the upper side of the tank cover 19.

The rotation shaft of the agitating motor 20 extends into the coolant tank 12 through the center of the tank cover 19, and the upper end of the agitator 18 is connected to the rotation shaft of the agitating motor 20. In addition, a water supply port 191 connected with a coolant supply hose is formed on one side of the tank cover 19.

In addition, a cold water pipe guide 212 guiding an inlet end and outlet end of the cold water pipe 13 and a water supply port accommodation part 211, in which the water supply port 191 is accommodated, are respectively formed in the case cover 21.

In addition, a plurality of guide grooves 121 are formed in the inner circumferential surface of the coolant tank 12 to extend downwardly by a predetermined length. Specifically, guide projections 141*b* (see FIG. 3) formed on the outer circumferential surface of the partitioning plate 14 are inserted into the guide grooves 121 to guide the partitioning plate 14. That is, in a state where the guide projections 141*b* are inserted into the guide grooves 121, the partitioning plate 14 moves downwardly until the guide projections 141*b* are locked to the lower ends of the guide grooves 121, thereby being fixed at a point downwardly spaced apart from the upper end of the coolant tank 12.

In addition, a plurality of guide projections 122 are formed on the outer circumferential surface of the coolant tank 12 to extend downwardly by a predetermined length. In addition, a plurality of guide grooves 111, into which the guide projections 122 are inserted, are formed in the inner circumferential surface of the insulation case 11. The guide projections are inserted into the guide grooves, such that the coolant tank 12 is accurately inserted into the insulation case 11, to prevent the coolant tank 12 from being shaken in the insulation case 11. The same is true in the partitioning plate 14.

In addition, the agitator 18 may include a shaft 181 connected to the motor shaft of the agitating motor 20 and a blade (or impeller) 182 formed on the lower end of the shaft 181. The shaft 181 may be formed to have a length which allows the blade 182 to be spaced apart downwardly from the lower end of the partitioning container 15 by a predetermined distance.

FIG. 2 is a perspective view of a partitioning container configuring a partitioner according to a first embodiment of the present invention.

Referring to FIG. 2, the partitioning container 15 according to the first embodiment of the present invention may include a body 152 composed of a cylindrical container (or a polygonal container) 152, a base 151 formed on the lower end of the body 152 and a head 155 extending from the upper end of the body 152.

Specifically, the body 152 has a grid structure (or net structure) formed by intersecting a plurality of vertical and horizontal ribs. Accordingly, a plurality of holes is formed in the body 152 by the intersecting ribs, such that coolant may flow to the inside/outside of the body 152 through the holes.

In addition, some of the plurality of vertical ribs configuring the body 152 may be defined as reinforcement ribs 156 having a greater horizontal width than the horizontal width of the other vertical ribs. The plurality of reinforcement ribs 156 may be spaced apart from each other at a predetermined gap in the circumferential direction of the body 152. By the plurality of reinforcement ribs 156, it is possible to minimize a phenomenon wherein the body 152 is deformed or damaged by external force.

The inner diameter of the body 152 may be less than the outer diameter of the blade 182 of the agitating member 18.

In addition, the base 151 may include a connection grid 151 horizontally extending from the lower end of the body 152 and a circular or polygonal seating end 151*b* formed on the outer end of the connection grid 151.

The connection grid 151*a* includes a plurality of ribs intersecting each other to form holes, through which coolant passes. Accordingly, coolant flowing to the upper side of the partitioning plate 14 may return to the lower side of the partitioning plate 14 through the connection grid 151*a*.

In addition, the seating end 151*b* is fitted into an agitator passing hole 14*a* (see FIG. 3) formed in the partitioning plate 14, and the outer circumferential surface of the seating end 151*b* is closely in contact with the inner circumferential surface of the agitator passing hole 14*a*.

According to the design condition, a fastening structure may be formed on the inner circumferential surface of an inner water flow guide sleeve 146 (see FIG. 4) defining the agitator passing hole 14*a* and the outer circumferential surface of the seating end 151*b*, such that the base 151 is fixed to the partitioning plate 14. A hook and a hook groove, into which the hook is fitted, may be proposed as an example of the fastening structure, but is not limited thereto.

Although described below, since the base 151 is inserted into the agitator passing hole 14*a* in a state where the head 155 is fixed to the bottom surface of the tank cover 19, the base 151 may not be fixed to the inner circumferential surface of the agitator passing hole 14*a*. That is, the outer circumferential surface of the base 151 may be closely in contact with or slightly spaced apart from the inner circumferential surface of the agitator passing hole 14*a*, that is, the inner circumferential surface of the inner water flow guide sleeve 146. The distance between the outer circumferential surface of the base and the inner circumferential surface of the agitator passing hole 14*a* may be defined as a distance which disallows the ice pieces formed around the evaporator 17 to pass through.

Meanwhile, the head 155 may include a plurality of fastening arms extending from the upper end of the body 152 in a radial direction and a fastening hook 155*b* protruding from the upper surface of the end of each fastening arm 155*a*. A locking projection 155*c* may protrude from the upper end of the outer surface of the fastening hook 155*b*.

Since the diameter of the body 152 is less than that of the conventional body, the thickness of ice generated on the evaporator 17 can be increased and thus the amount of stored ice is increased, thereby preventing ice from moving into the body 152 in the process of increasing the size of the ice.

FIG. 3 is a planar perspective view of the partitioning plate configuring the partitioner according to the first embodiment of the present invention, and FIG. 4 is a bottom perspective view of the partitioning plate.

Referring to FIGS. 3 and 4, the partitioning plate 14 according to the embodiment of the present invention may include a grid plate 141, the planar shape of which being equal to the cross-sectional shape of the coolant tank 12 and an edge rib 141*a* extending upwardly from the outer edge of the grid plate 141.

Specifically, the outer circumferential surface of the edge rib 141*a* is closely in contact with the inner circumferential surface of the coolant tank 12. Guide projections 141*b* are formed on the outer circumferential surface of the edge rib 141*a* and are inserted into the guide grooves 121 formed in the inner circumferential surface of the coolant tank 12.

In addition, the grid plate 141 is horizontally placed inside the coolant tank 12 and grid ribs formed by intersecting ribs in the horizontal and vertical directions are formed in the grid plate 141. The coolant at the upper side of the grid plate 141 and the coolant at the lower side of the grid plate 141 may circulate through the grid plate 141, but the ice generated at the upper side of the grid plate 141 can not move to the lower side of the grid plate 141.

In addition, the agitator passing hole 14*a* having a size corresponding to the outer diameter of the base 151 is formed in the grid plate 141 and is defined by an inner water flow guide sleeve 146. The inner water flow guide sleeve 146 may be defined as an inner sleeve.

In addition, an outer water flow guide sleeve 142 may be formed to extend on the bottom surface of the grid plate 141. The outer water flow guide sleeve 142 may be defined as an outer sleeve.

Specifically, the outer water flow guide sleeve 142 may be formed outside the inner water flow guide sleeve 146, and a plurality of water flow guide projections 142*a* may be formed on the outer circumferential surface of the outer water flow guide sleeve 142. The plurality of water flow guide projections 142*a* may extend downwardly from the bottom surface of the grid plate 141 by a predetermined length and may be spaced part from each other at a predetermined gap in the circumferential direction of the outer water flow guide sleeve 142.

By forming the water flow guide projections 142*a*, the flow of coolant rising while rotating in the spiral shape by the agitator 18 may collide with the water flow guide projections 142, thereby vertically rising.

In addition, the upper end of the outer water flow guide sleeve 142 may be flush with the upper surface of the grid plate 141 and may further protrude from the upper surface of the grid plate 141 by a predetermined length.

In addition, an evaporator support rib 142*b* may extend upwardly from the upper surface of the grid plate 141 corresponding to the upper end of the outer water flow guide sleeve 142 by a predetermined length and an end portion thereof may be bent toward the center of the grid plate 141. The evaporator support rib 142*b* may prevent the evaporator 17 from horizontally vibrating and hold a lump of ice from being grown on the outer circumferential surface of the evaporator 17.

In addition, a plurality of evaporator seating ribs 147 may be formed on the upper surface of the grid plate 141 corresponding to the region between the inner water sleeve guide sleeve 146 and the outer water flow guide sleeve 142. The plurality of evaporator seating ribs 147 are spaced apart from each other at a predetermined gap in the circumferential direction of the inner water sleeve guide sleeve 146. A seating groove 147*a*, in which the evaporator 17 is seated, may be formed in the outer upper surface of the evaporator seating ribs 147. Accordingly, when the evaporator 17 is seated in the seating groove 147*a*, the evaporator seating ribs 147 can prevent the evaporator 17 from horizontally vibrating.

In addition, a cold water pipe guide rib 148 for guiding the cold water pipe may be formed on one edge of the grid plate 141 to extend upwardly by a predetermined length. The cold water pipe guide rib 148 may be rounded to surround the outer circumferential surface of the cold water pipe 13 and may be formed to have two rounded portions to surround a suction-side cold water pipe and a discharge-side cold water pipe.

By forming the cold water pipe guide rib 148, it is possible to prevent ice grown on the surface of the evaporator 17 from being directly brought into contact with the cold water pipe 13. Therefore, it is possible to solve a problem that the ice freezes the cold water flowing in the cold water pipe 13 to interrup the cold water flowing.

Meanwhile, a plurality of cold water pipe seating ribs 149 may be formed between the inner water sleeve guide sleeve 146 and the outer water flow guide sleeve 142, and may be spaced apart from each other at a predetermined gap in the circumferential direction of the inner water sleeve guide sleeve 146. The cold water pipe seating ribs 149 are connected to the outer circumferential surface of the inner water sleeve guide sleeve 146 and the inner circumferential surface of the outer water flow guide sleeve 142.

A seating groove 149*a* is formed in each cold water pipe seating rib 149 and an uppermost side of the cold water pipe 13 is seated in and supported by the seating groove 149*a*.

The lowermost side of the cold water pipe 13 is seated in and supported by a cold water pipe seating rib 123 (see FIG. 12) formed on the bottom of the coolant tank 12.

FIG. 5 is a planar perspective view of a tank cover according to an embodiment of the present invention, FIG. 6 is a bottom perspective view of the tank cover, and FIG. 7 is a vertical cross-sectional view showing a coupling relationship between the tank cover and the partitioning container.

Referring to FIGS. 5 and 6, the tank cover 19 according to the embodiment of the present invention includes a cover body 191 including a bottom portion 192 having the same shape as the cross-sectional shape of the coolant tank 12 and a side surface portion 193 extending upwardly from the edge of the bottom portion 192.

Specifically, the bottom portion 192 covers the opened upper surface of the coolant tank 12, and the outer circumferential surface of the side surface portion 193 is closely in contact with the inner circumferential surface of the upper end of the coolant tank 12. In addition, a plurality of fastening projections 193*a* may protrude from the outer circumferential surface of the side surface portion 193, and cover fastening grooves 123, into which the fastening projections 193*a* are respectively fitted, may be formed in the inner circumferential surface of the upper end of the coolant tank 12.

In addition, a motor insertion hole 191*a* is formed in the center of the bottom portion 192 and a motor sleeve 194 extends upwardly from the edge of the motor insertion hole 191*a*. The agitating motor 20 is inserted into the motor insertion hole 191*a* and is supported by the motor sleeve 194.

In addition, an evaporation pipe guide portion 197 may be formed at one side of the edge of the bottom portion 192 to be rounded at a predetermined curvature. The evaporation pipe guide portion 197 covers and protects the inlet-side and outlet-side pipes of the evaporator 17.

In addition, a plurality of evaporator support ribs 196 protrude from the bottom surface of the bottom portion 192. According to the present invention, although three evaporator support ribs may extend to support the upper surface of the evaporator 17 at three points, the number of evaporator support ribs 196 is not limited thereto.

A plurality of arm fasteners 195 may be formed in the outer edge of the motor insertion hole 191*a*, and the fastening hook 155*b* configuring the head 155 of the partitioning container 15 may be inserted into the arm fastener 195*b*.

Referring to the enlarged view of the portion A of FIG. 7, the arm fastener 195 protrudes upwardly from a point of the bottom portion 192 adjacent to the outer edge of the motor sleeve 194, thereby forming an accommodation groove 195*a*. That is, the arm fastener 195 is recessed upwardly from the bottom surface of the bottom portion 192. A locking projection 195*b* may protrude from the inner side surface of the accommodation groove 195*a*.

Specifically, when the fastening hook 155*b* is inserted into the accommodation groove 195*a*, the locking projection 155*c* protruding from the outer circumferential surface of the fastening hook 155*b* moves over the locking projection 195*b* of the accommodation groove 195*a* to be locked to the upper surface of the locking projection 195*b*. As a result, the partitioning container 15 is coupled to the tank cover 19. In order to separate the partitioning container 15 from the tank cover 19, the partitioning container 15 should be pulled with strength for enabling the locking projection 155*c* to move over the locking projection 195*b* of the accommodation groove 195*a*.

in a state where the partitioning container 15 is coupled to the tank cover 19, the shaft 181 of the agitator 18 is inserted into the partitioning container 15 from the lower side of the partitioning container 15 to couple the upper end of the shaft 181 to the rotation shaft of the agitating motor 20. Then, since the blade 182 of the agitator 18 is located below the lower end of the partitioning container 15, it is possible to design the inner diameter of the partitioning container 15 to be less than the outer diameter of the blade 182.

Of course, since the blade 182 should pass through the agitator passing hole 14*a* of the partitioning plate 14, the diameters of the base 151 of the partitioning container 15 and the agitator passing hole 14*a* should be greater than the diameter of the blade 182.

FIG. 8 is a perspective view of a partitioner according to a second embodiment of the present invention, FIG. 9 is a perspective view of a partitioning container configuring the partitioner according to the second embodiment of the present invention, FIG. 10 is a planar perspective view of a partitioning plate according to the second embodiment of the present invention, and FIG. 11 is a bottom perspective view of the partitioning plate according to the second embodiment of the present invention.

The partitioner according to the second embodiment of the present invention is different from the partitioner according to the first embodiment of the present invention as follows.

First, a flow guide member is formed on the upper surface of the partitioning plate. The flow guide member is configured to guide the coolant rising in the lower space of the coolant tank to flow to the upper region of the evaporator through the partitioning plate.

Second, the length of the partitioning container is decreased by the upward extension length of the flow guide member.

Since the configuration of the partitioner according to the second embodiment of the present invention is identical to the configuration of the partitioner according to the first embodiment except for the above-described differences, the same components are denoted by the same reference numerals and thus a repeated description thereof will be omitted.

Referring to FIGS. 8 to 11, the flow guide member extends in the form of a blocking sleeve 146*a* rather than a grid structure, and the blocking sleeve 146*a* extends upwardly from the upper end of the inner water flow guide sleeve 146 by a predetermined length. That is, the blocking sleeve 146*a* may be regarded as an extension of the inner water flow guide sleeve 146.

In addition, the length of the partitioning container 15 is decreased by the extension length of the blocking sleeve 146.

In addition, the seating sleeve 146*b* may further extend from the upper end of the blocking sleeve 146*a*, and the outer diameter of the seating sleeve 146*b* is less than that of the blocking sleeve 146*a* such that a seating step 146*c* is formed at the boundary between the blocking sleeve 146*a* and the seating sleeve 146*b*.

In addition, the outer circumferential surface of the seating sleeve 146*b* is closely in contact with the inner circumferential surface of the seating end 151*b* of the partitioning container 15. In addition, the width (vertical length) of the seating sleeve 146*b* may correspond to the width (vertical length) of the seating end 151*b* such that the lower end of the seating end 151*b* is brought into contact with the seating step 146*c*.

The lower end of the partitioning container 15 is fitted into the upper end of the blocking sleeve 146*a*, thereby minimizing vibration of the partitioning container 15.

FIG. 12 is a cross-sectional view showing flow of coolant in a cooling unit according to the second embodiment of the present invention.

Referring to FIG. 12, when the agitator 18 rotates, the coolant flows in the coolant tank 12. As denoted by an arrow, flow of coolant moving to the upper side of the partitioning plate 14 and flow of coolant moving to the lower side of the partitioning plate 14 are formed.

Specifically, when the agitator 18 rotates, the coolant at the upper side of the partitioning plate 14 and colder than the coolant at the lower side of the partitioning plate 14 moves downwardly while rotating in the spiral shape along the upper surface of the blade of the agitator 18.

In addition, the coolant separated from the lower end of the upper surface of the blade of the agitator 18 collides with the cold water pipe 13 to be divided into rising coolant flow and falling coolant flow. The falling coolant falls to the bottom of the coolant tank 12 along the inner surface of the cold water pipe 13. The coolant falling to the bottom of the coolant tank 12 exchanges heat with the coolant located in the lower space of the coolant tank 12, such that the temperature of the coolant becomes uniform. At the same time, the coolant exchanges heat with the cold water pipe 13 to cool the drinking water flowing along the cold water pipe 13.

The coolant falling to the bottom of the coolant tank 12 collides with the bottom of the coolant tank 12 to be divided into flow of coolant flowing toward the center of the cold water pipe 13 and then rising, and flow of coolant flowing in the outward direction of the cold water pipe 13 and then rising to a space between the side surface of the coolant tank 12 and the cold water pipe 13.

The coolant rising at the outside of the cold water pipe 13 should rise to a region close to the upper end of the coolant tank 12 through the partitioning plate 14, in order to improve heat exchange efficiency.

Specifically, since the evaporator 17 is placed on the partitioning plate 14, the temperature of the upper side region of the partitioning plate 14 is less than the lower side region of the coolant tank 12. Since ice is generated around the evaporator 17, it is preferable that the coolant located on the bottom of the coolant tank 12 rises as high as possible to exchange heat with the coolant or the ice around the evaporator 17 and then fall. To this end, the outer water flow guide sleeve 142 is formed.

More specifically, referring to solid arrows "a", the coolant rising from the bottom of the coolant tank 12 along the side surface of the coolant tank 12 collides with the outer water flow guide sleeve 142 to vertically rise and then moves toward the evaporator 17. If the outer water flow guide sleeve 142 is not present, the rising coolant may not pass through the partitioning plate 14 and may return to the inner space of the cold water pipe 13.

Meanwhile, the coolant guided to the evaporator 17 by the outer water flow guide sleeve 142 exchanges heat with the evaporator 17 or the ice generated on the surface of the evaporator 17 and then flows into the partitioning container 15 through the holes (grid holes) formed in the body 152 of the partitioning container 15. In addition, the coolant flowing into the partitioning container 15 falls while rotating in the spiral shape by rotation of the agitator 18.

In addition, the coolant separated from the lower end of the agitator 18 and rising along the inner surface of the cold water pipe 13 rises toward the inner space of the evaporator 17 through the partitioning plate 14.

Referring to solid arrows "b", the coolant rising through the partitioning plate 14 collides with the inner water flow guide sleeve 146 to rise to the upper side of the partitioning container 15. The coolant rising to the upper side of the partitioning container 15 further rises by the blocking sleeve 146*a* to exchange heat with the evaporator 17 or the ice generated on the surface of the evaporator 17 and then flows into the partitioning container 15, thereby forming falling coolant flow.

In the first embodiment, the blocking sleeve 146*a* is not present. In contrast, in the second embodiment, since the blocking sleeve 146*a* is further included, the second embodiment may be more advantageous than the first embodiment in forming rising coolant flow.

If the body 152 of the partitioning container 15 includes, as the conventional structure, the grid 154 without the inner water flow guide sleeve 146 and the blocking sleeve 146*a*, the coolant passing through the partitioning plate 14 does not rise to the upper space of the partitioning container 15 and thus heat exchange with the evaporator 17 or the ice generated on the evaporator 17 is not sufficiently performed.

FIG. 13 is a perspective view of a partitioning container configuring a cooling unit according to a third embodiment of the present invention.

Referring to FIG. 13, the partitioning container 15 according to the third embodiment is different from that of the previous embodiments in that the body 152 is divided into a grid 154 and a blocking portion 153, and is equal thereto in the other configuration.

Specifically, according to the third embodiment, similarly to the previous embodiments, the outer diameter of the body 152 configuring the partitioning container 15 is less than that of the base 151 and the body 152 is coupled to the bottom surface of the tank cover 19.

The upper portion of the body 152 includes the grid 154 and the other lower portion of the body 152 includes the blocking portion 153, through which coolant does not passes. Accordingly, the coolant guided to the upper side of the partitioning plate 14 by the outer water flow guide sleeve 142 and the inner water flow guide sleeve 146 further rises by the blocking portion 153, flows into the partitioning container 15 through the grid 154 and then falls.

That is, the blocking portion 153 performs the function of the blocking sleeve 146*a* according to the second embodiment.

Of course, according to the design consideration considering flow resistance, the partitioning container 15 may be seated in the blocking sleeve 146*a* and the blocking portion 153 may be formed in a lower portion of the partitioning container 15 seated in the blocking sleeve 146*a*.

The invention claimed is:

1. A water purifier comprising:

a coolant tank configured to store coolant;

a tank cover covering an opened upper surface of the coolant tank;

an agitating motor mounted in the tank cover;

a partitioning container including a head coupled to the tank cover, a cylindrical body extending from the head and including a grid rib, and a base formed on a lower end of the body;

a partitioning plate configured to partition an internal space of the coolant tank into an upper space and a lower space and having a grid rib formed therein to enable coolant of the upper space and coolant of the lower space to circulate;

an evaporator disposed in the upper space and provided to surround the partitioning container;

a cold water pipe disposed in the lower space, the cold water pipe being wound in a spiral shape; and an agitator including a shaft inserted into the body and connected to a rotation shaft of the agitating motor and a blade formed on a lower end of the shaft and placed in a cylindrical space formed by the spiral shape of the cold water pipe, wherein an inner diameter of the body is less than an outer diameter of the blade.

2. The water purifier of claim 1, wherein the head includes:

a plurality of fastening arms radially extending from an upper end of the body; and a tank cover fastener formed on an end of each of the plurality of fastening arms, and wherein an arm fastener coupled with the tank cover fastener is formed on the tank cover.

3. The water purifier of claim 2, wherein the tank cover fastener is detachably coupled to the arm fastener.

4. The water purifier of claim 2, wherein the tank cover fastener includes a fastening hook protruding from an upper surface of an end of each of the fastening arms, and wherein the arm fastener protrudes from an upper surface of the tank cover and includes a reception groove, into which the fastening hook is inserted.

5. The water purifier of claim 4, wherein a fastening projection protrudes from an outer circumferential surface of the fastening hook, wherein a locking projection protrudes from an inner circumferential surface of the reception groove, and wherein the fastening projection is locked by the locking projection such that the fastening hook is fixed in the reception groove.

6. The water purifier of claim 1, further comprising an outer water flow guide sleeve extending from a bottom surface of the partitioning plate and surrounding an outer edge of the cold water pipe.

7. The water purifier of claim 6, further comprising a plurality of water flow guide projections protruding from an outer circumferential surface of the outer water flow guide sleeve, extending in a vertical direction and spaced apart from each other in a circumferential direction of the outer water flow guide sleeve.

8. The water purifier of claim 1, wherein an outer diameter of the base is greater than that of the blade.

9. The water purifier of claim 8, further comprising an inner water flow guide sleeve extending from a bottom surface of the partitioning plate and surrounding an inner edge of the cold water pipe, wherein a through-hole is formed in the inner water flow guide sleeve.

10. The water purifier of claim 9, wherein the blade passes through the through-hole to be placed in the lower space.

11. The water purifier of claim 9, wherein the base includes:

a circular seating end having a greater diameter than the body; and a connection grid connecting a lower end of the body with the seating end.

12. The water purifier of claim 11, wherein the seating end is fitted into the through-hole.

13. The water purifier of claim 11, wherein the body includes:

a grid including the grid rib to allow the coolant to pass therethrough; and a blocking portion formed below the grid to block passage of the coolant.

14. The water purifier of claim 11, further comprising a blocking sleeve extending upwardly from an edge of the through-hole so as to prevent the coolant rising through the partitioning plate from flowing into the through-hole, and wherein the seating end is seated on an upper end of the blocking sleeve.

15. The water purifier of claim 14, further comprising a seating sleeve having a greater outer diameter than the blocking sleeve and extending from an upper end of the blocking sleeve, wherein the seating end is fitted into an outer circumferential surface of the seating sleeve.

16. The water purifier of claim 14, wherein the body includes:

a grid including the grid rib to allow the coolant to pass therethrough; and a blocking portion formed below the grid to block passage of the coolant.

* * * * *